US006218776B1

(12) United States Patent
Cull et al.

(10) Patent No.: US 6,218,776 B1
(45) Date of Patent: Apr. 17, 2001

(54) ENHANCED BRIGHTNESS OF FLAT FLUORESCENT LAMP

(75) Inventors: Brian D. Cull; Elias S. Haim, both of Glendale, AZ (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/223,233

(22) Filed: Dec. 30, 1998

(51) Int. Cl.[7] ..... H01J 61/30
(52) U.S. Cl. ..... 313/493; 313/634
(58) Field of Search ..... 313/493, 634, 313/577, 571, 477 R; 445/26, 43, 44, 25

(56) References Cited

U.S. PATENT DOCUMENTS

| | | |
|---|---|---|
| 2,733,368 | 1/1956 | Kolkman . |
| 3,121,184 | 2/1964 | Fox . |
| 3,258,630 | 6/1966 | Scott . |
| 3,508,103 | 4/1970 | Young . |
| 4,363,998 | 12/1982 | Graff et al. . |
| 4,575,656 | 3/1986 | Anderson, Jr. et al. . |
| 4,743,799 | 5/1988 | Loy . |
| 4,851,734 | 7/1989 | Hamai et al. . |
| 4,899,080 | 2/1990 | Vriens et al. . |
| 5,220,249 | 6/1993 | Tsukada . |
| 5,319,282 | 6/1994 | Winsor . |
| 5,343,116 | 8/1994 | Winsor . |
| 5,463,274 | 10/1995 | Winsor . |
| 5,466,990 | 11/1995 | Winsor . |
| 5,479,069 | 12/1995 | Winsor . |
| 5,479,071 | 12/1995 | Lynn . |
| 5,509,841 | 4/1996 | Winsor . |
| 5,536,999 | 7/1996 | Winsor . |
| 5,818,164 | 10/1998 | Winsor . |
| 5,850,122 | 12/1998 | Winsor . |

*Primary Examiner*—Ashok Patel

(57) ABSTRACT

A flat fluorescent lamp exhibits increased brightness through selective angular tuning of emitted light. A diffuse channel is formed in a substrate such that the upper portions of the channel walls taper inward toward the diffuse channel cavity to cause light to be emitted from the lamp in a more intense cone of viewable light over a narrow range of viewable angles. The interior of the channel may be at least partially covered by additional materials, such as a reflective material for enhancing brightness.

24 Claims, 5 Drawing Sheets

ENHANCED BRIGHTNESS OF FLAT FLUORESCENT LAMP

BACKGROUND OF THE INVENTION

1. Technical Field

The present invention generally relates to flat fluorescent lamps and, more particularly, enhancing brightness of flat fluorescent lamps.

2. Background

It is often desirable to have a flat fluorescent lamp where brightness can be enhanced by tuning light into a smaller, yet more intense, viewable cone. Such a lamp is useful in many applications, such as displays in avionics applications and for automatic teller machine displays.

Typical flat fluorescent lamps, for example, U.S. Pat. No. 5,343,116, issued Aug. 30, 1994, to Winsor, are constructed having a substrate frit to a transparent cover lid, forming an enclosure. Diffuse channels are milled into the substrate such that they are located in the interior of the enclosure. Standard phosphors are added to the interior of the enclosure just before it is flushed with a material for emitting energy, such as argon or mercury. Energy is emitted in the form of visible light when an electric potential is introduced to the lamp.

In the past, attempts have been made to enhance flat fluorescent lamp brightness through use of reflective materials for redirecting light. U.S. Pat. No. 5,818,164, issued Oct. 6, 1998, to Winsor, discloses application of a reflective coating to the substrate exterior to reflect light back into the lamp to increase output. U.S. Pat. No. 5,479,069, issued Dec. 26, 1996, to Winsor, discloses application of reflective materials to the interior portion of the lamp to redirect light that would have been lost through rear emission. The result of applying reflective materials in this manner is to effect the forward emission of substantially all light produced by the lamp. While the addition of reflective material has enhanced the lamp efficacy, in that more light is emitted from the lamp without requiring an increase in power, these designs result in wasted light because the light is emitted in a viewable cone that exceeds the range of viewing angles required by the particular application. Therefore, even though use of reflective materials can enhance flat fluorescent lamp efficacy, a significant portion of the emitted light is wasted because it falls outside the desired viewing range. Further, the addition of reflective materials can add complexity and cost to the manufacturing process.

Attempts have also been made to enhance flat fluorescent lamp brightness by altering the shape of the diffuse channel to redirect light. For example, the flat fluorescent lamp described in U.S. Pat. No. 5,479,069 has a diffuse channel that has a symmetrical cross-section with the upper portion of the channel walls tapering outward from the diffuse channel cavity. While this type of configuration acts to enhance efficacy by directing light forward, it exits the cover lid in a viewable cone of light that is greater than the desired range of viewing angles for the application for which the lamp is designed. Therefore, even though more light is exiting the lamp, light that falls outside the desired viewing range is wasted because the outward-tapered, symmetrically-shaped diffuse channel of the prior art lamps does not enable the intensification of forward-emitted light into a focused viewing cone.

Other prior art designs have similarly utilized channel shape to force the reflected light to exit the lamp in a forward direction. Referring to FIGS. 2A–E, as light is emitted from the flat fluorescent lamp, it strikes channel wall 112 and is reflected at roughly the same angle as it approached the wall. This causes in increase in efficacy, as more light is exiting the lamp over the desired viewing angle without requiring a corresponding increase in power input. Prior art designs shown in FIGS. 2A–E are exemplary of diffuse channel 116 cross-sections that have been configured to improve flat fluorescent lamp efficacy. These figures show a diffuse channel cross-section that is symmetrical through the vertical plane and is milled so that the upper portion of channel wall 112 tapers outward away from the diffuse channel cavity 122. This outward tapering can be slight, such as FIG. 2E, or it can be extreme, as seen in FIGS. 2A–B. These symmetrical, outward-tapered diffuse channel designs assist light in being forward-emitted by having a configuration that permits light striking the channel wall to exit through cover lid 114 (as seen in FIG. 1B). This increases the efficacy of the lamp, in that overall lamp output is now greater without requiring a corresponding increase in power. However, light emitted through cover lid 114 is emitted as a cone of light that covers the full range of angles. Often, however, only a small range of the visible cone of light is needed for a particular application. Therefore, all light that falls outside that desired range is wasted because the resulting forward-emitted viewing cone of the prior art design is too large compared to the desired viewing cone for many applications.

SUMMARY OF THE INVENTION

A flat fluorescent lamp according to various aspects of the present invention exhibits brightness enhancement through selective angular tuning of the emitted cone of light. A cover lid is attached to a substrate to form an enclosure that has interior and exterior portions. A fluorescent material and a material for emitting energy in response to an electric potential are placed suitably in the interior portion of the enclosure. A diffuse channel is formed such that the shape of the channel selectively tunes light exiting the cover lid into an intensified cone of light that corresponds to the requirements of the lamp's intended application.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the claims and the accompanying drawings, in which like parts may be referred to by like numerals:

DETAILED DESCRIPTION OF THE PREFERRED EXEMPLARY EMBODIMENTS

The ensuing descriptions are preferred exemplary embodiments only, and are not intended to limit the scope, applicability, or configuration of the invention in any way. Rather, the ensuing descriptions provide a convenient description for implementing a preferred embodiment of the invention, it being understood that various changes may be made in the function and arrangement of elements described in the preferred embodiments without departing from the spirit and scope of the invention as set forth in the appended claims.

Figure 1A:
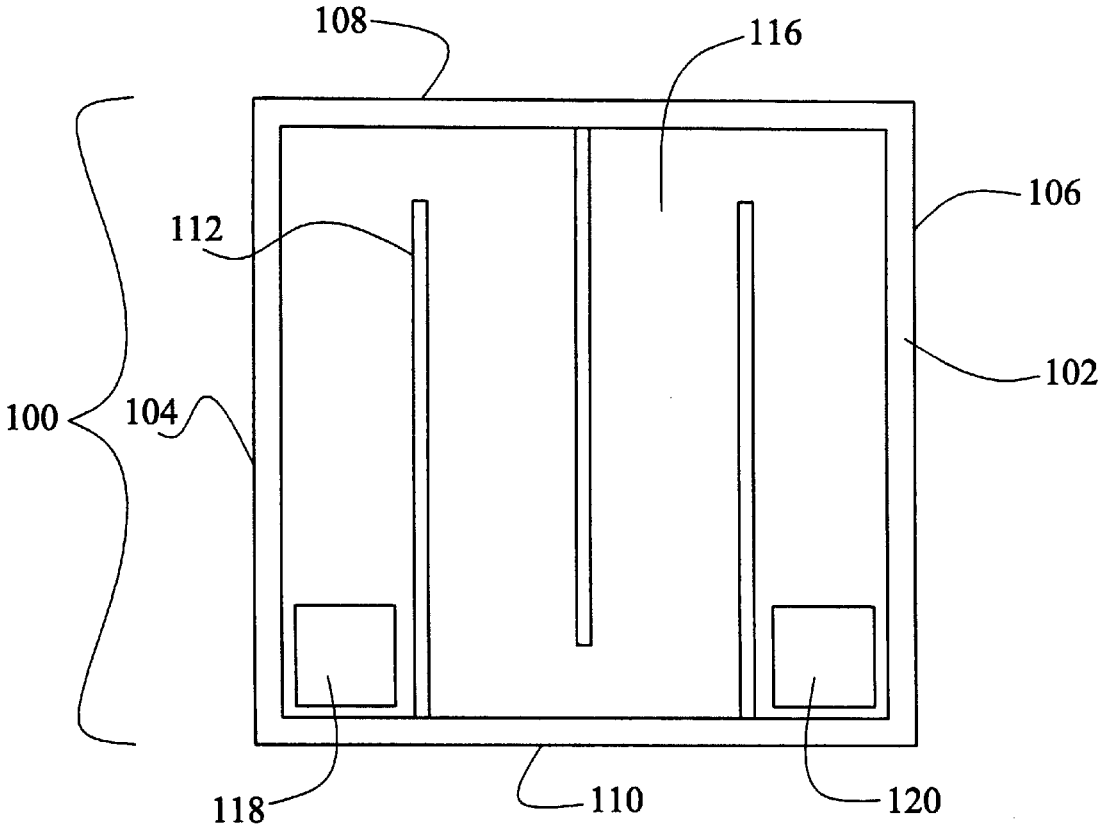
FIG. 1A is a plan view of a flat fluorescent lamp.
Figure 1B:
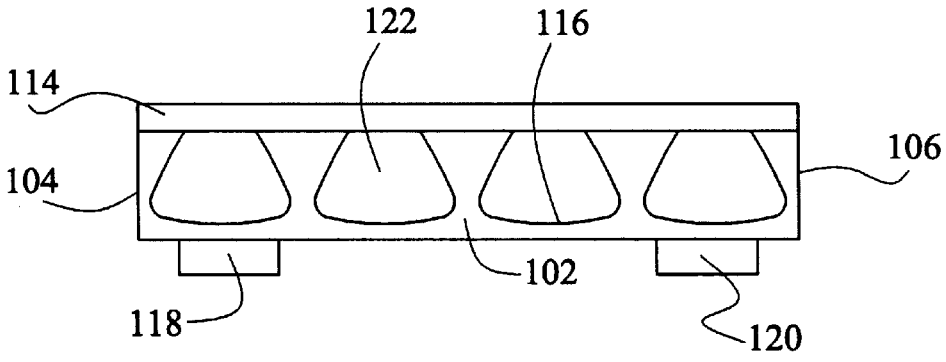
FIG. 1B is a cross-sectional view of the device of 1A.
Figure 2A:
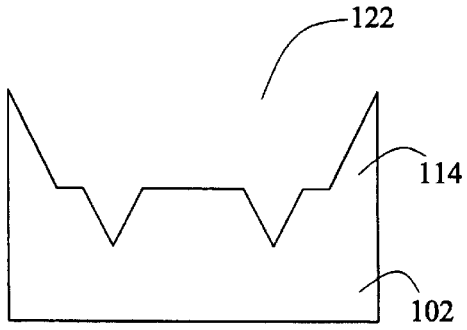
Fig.2A (Prior Art)
FIGS. 2A–E are cross-sectional views of prior art lamp diffuse channel shapes.
Figure 2B:
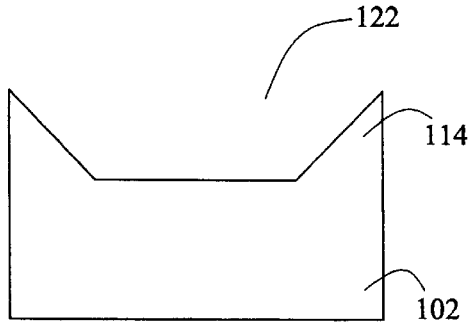
Fig.2B (Prior Art)
Figure 2C:
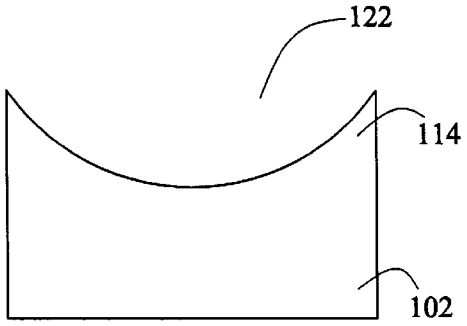
Fig.2C (Prior Art)
Figure 2D:
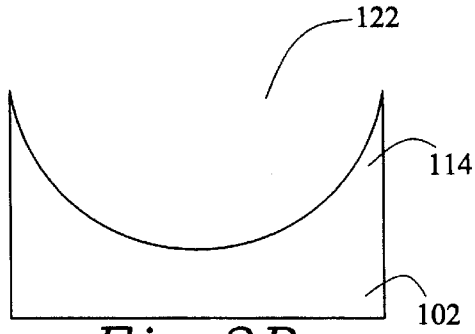
Fig.2D (Prior Art)
Figure 2E:
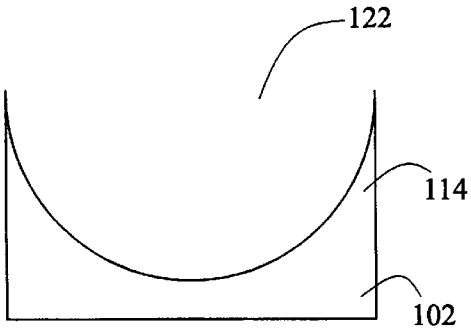
Fig.2E (Prior Art)

Referring to FIGS. 1A–B, a flat fluorescent lamp 100 includes a substrate 102 having two sidewalls 104 and 106 and two end walls 108 and 110 forming a rectangular perimeter. Substrate 102 is formed of any suitable material that is preferably rigid and self-supporting, such as glass or ceramic. A diffuse channel 116 is formed by at least one channel wall 112 extending from substrate 102 to cover lid 114. Channel walls 112 extend in one direction and then alternate to the other direction so that a continuous channel is formed within substrate 102 from one corner to another. A transparent cover lid 114 is suitably attached to substrate 102 such that the lid 114 and the top portion of sidewalls 104 and 106, end walls 108 and 110, and channel walls 112 form an enclosure within lamp 100. The transparent cover lid 114 is preferably constructed of a material having a coefficient of thermal expansion that substantially matches that of substrate 102.

At least a portion of the enclosure interior is coated with a material that fluoresces in the visible spectrum when bombarded with ultraviolet radiation. The fluorescent material may be any material that produces light upon bombardment of ultraviolet radiation, such as phosphors, and more particularly, rare earth phosphors. Additionally, a plasma or other ultraviolet emissive material, such as mercury and argon, is placed in the enclosure.

The plasma or other emissive material is ignited through sparking caused by the electric potential between two electrodes contained in filament housings 118 and 120. For example, filament wires (not shown) are suitably contained in filament housings 118 and 120 and extend into lamp 100 for exciting the plasma or other ultraviolet emissive material. Filament housings 118 and 120 are suitably located on the bottom exterior of substrate 102. To create filament housings 118 and 120, small glass bodies contain the filaments which are with a glass frit, with the glass frit having a lower melting point than that of the filament housing. The attachment of the filament housing 118 and 120, which are suitably soldered to the bottom exterior of substrate 102 with the filament wires in place, can have a variety of configurations as to their location and attachment. Filament housings 118 and 120 may be located on the same side corners or opposite corners of the bottom exterior of substrate 102 or in any other suitable configuration to facilitate excitation of the plasma or other emissive material in the channel 116, such as at opposite ends of the arc created by diffuse channel 116.

Figure 3A:
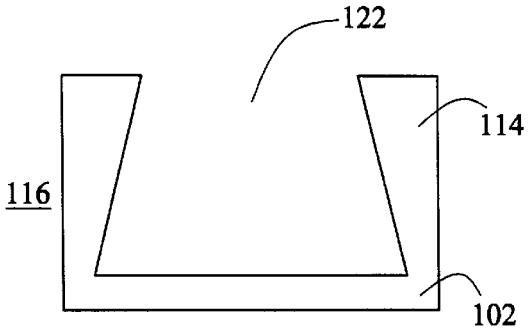
FIGS. 3A–E are cross-sectional views of exemplary embodiments of diffuse channel shapes according to the various aspects of the present invention.

Diffuse channel 116 may be formed in many shapes to provide the desired tuning. A lamp according to various aspects of the present invention harnesses the light that would have been otherwise wasted due to light emission outside of the desired viewable range. This results in the selective angular tuning of emitted light into a more intense cone of viewable light without requiring a greater power input. Referring to FIGS. 3A–C, diffuse channel 116 has a cross-section that has a symmetrical shape and channel walls that are formed in substrate 102 so that the top portion of channel wall 112 tapers inward toward the diffuse channel cavity 122. When light hits channel wall 112, it is reflected at approximately the same angle as it struck the wall, forcing it toward cover lid 114. However, the tapering inward toward diffuse channel cavity 122 forces the light to exit cover lid 114 in a focused cone of light that is the desired range for the particular application. This enables the lamp to emit the same amount of light over a smaller area in a more concentrated range of viewing angles, resulting in a substantially brighter cone of emitted light.

Figure 3D:
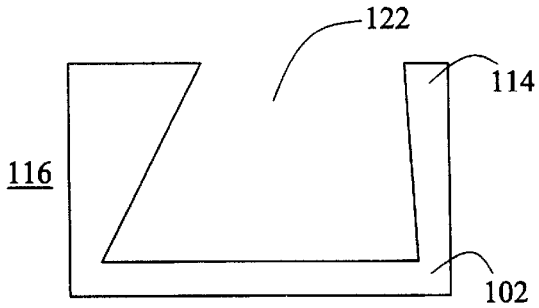
Figure 3B:
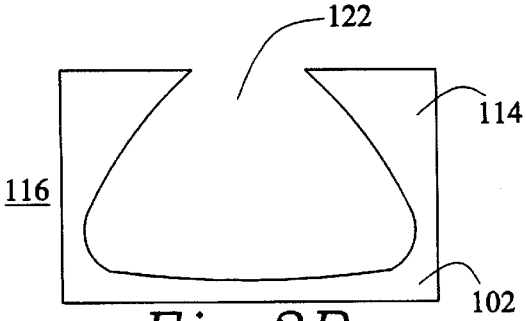
Figure 3E:
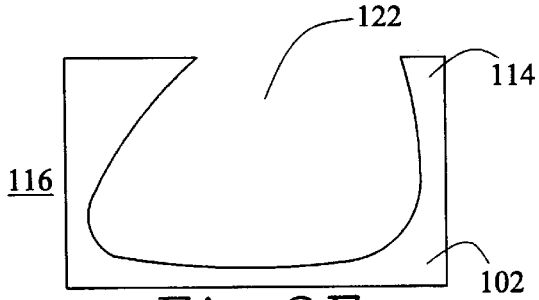
Figure 3C:
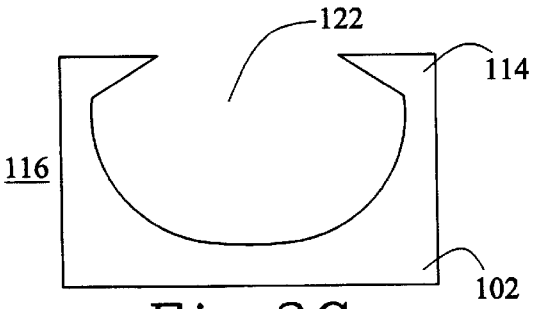

In FIGS. 3D–E, the diffuse channel 116 of a display according to various aspects of the present invention has a cross-section that is asymmetrical and a channel wall 112 formed such that the top portion tapers inward toward the diffuse channel cavity 122. This type of design, which functions similarly to the symmetrical design, is useful in applications where light is viewed from only one direction, such as at an automatic teller machine display where the individual stands over the display unit. The resulting selective angular tuning of emitted light from this design also yields a concentrated cone that is designed to correspond to the desired range of viewable angles for the particular application.

The amount of light tuning that is desired for a particular application can be adjusted based on the amount of channel wall 112 tapering. Preferably, the angle of inward tapering of the upper portion of channel wall 112 is between 0° and 45°, and more preferably, is between 1° and 30°. Nonetheless, the brightness of the flat fluorescent lamp tends to be enhanced even where the degree of channel wall 112 tapering exceeds the preferred range; however, some light may be reflected back into the channel, yielding a light-recycling effect that may inhibit the lamp from achieving optimal brightness enhancement through tuning, depending on the light absorption properties of the lamp channel. Therefore, even though there is an optimum range of tapering, brightness may be enhanced even where the degree of tapering exceeds the preferred range.

In alternate embodiments, additional materials may be included to enhance lamp performance. For example, a semi-transparent layer may also be applied to at least some portion of the interior of the enclosure to prevent ultraviolet emissive material migration into the fluorescent material or into the matrix of substrate 102 or cover lid 114. The semi-transparent layer can be any suitable material, such as an aluminum oxide, which tends to extend the useful life of the lamp.

Figure 4:
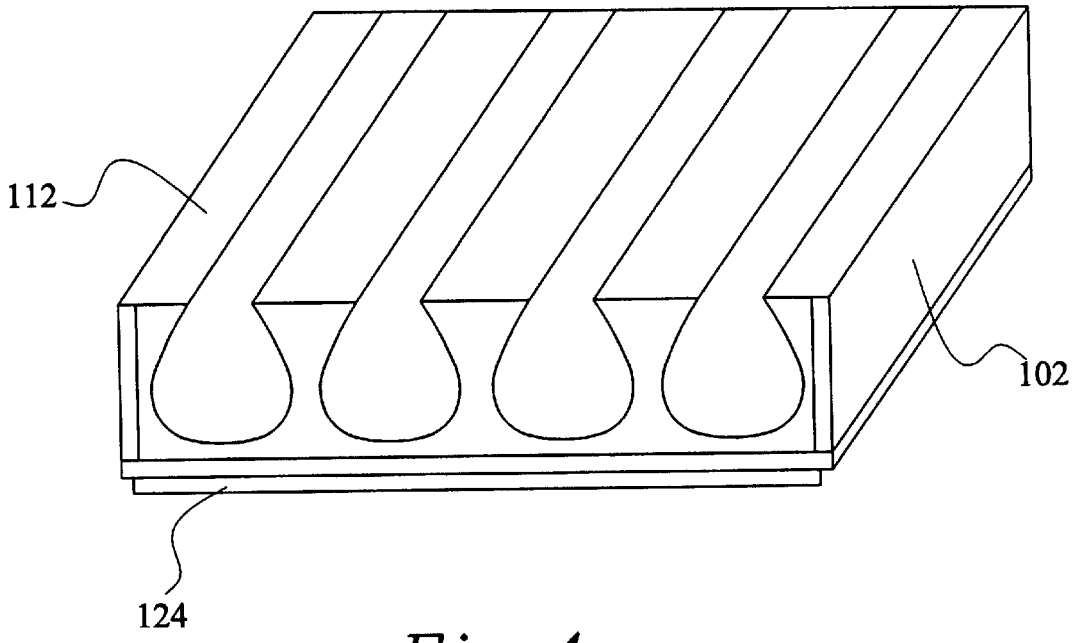
FIG. 4 is a cut-away view of a flat fluorescent lamp with a reflective coating on the exterior of the substrate.

In other embodiments reflective material 124, such as aluminum or ceramics, may be used to further enhance the flat fluorescent lamp's brightness. Reflective material 124 may be placed in any suitable configuration, such as the exterior bottom of substrate 102 (shown in FIG. 1) or in the enclosure interior of the lamp. For example, referring to FIG. 4, the application of reflective material 124 to the bottom exterior of substrate 102 tends to redirect light that would have been rear-emitted. Consequently, light that would have escaped through the bottom of substrate 102 may be directed forward and emitted as viewable light through cover lid 114 (as seen in FIG. 1B). Reflective material 124 applied to the exterior of the substrate for capturing rear-emitted light in combination with the diffuse channel 116 shaped to tune the light, provides further brightness enhancement to the flat fluorescent lamp.

Figure 5:
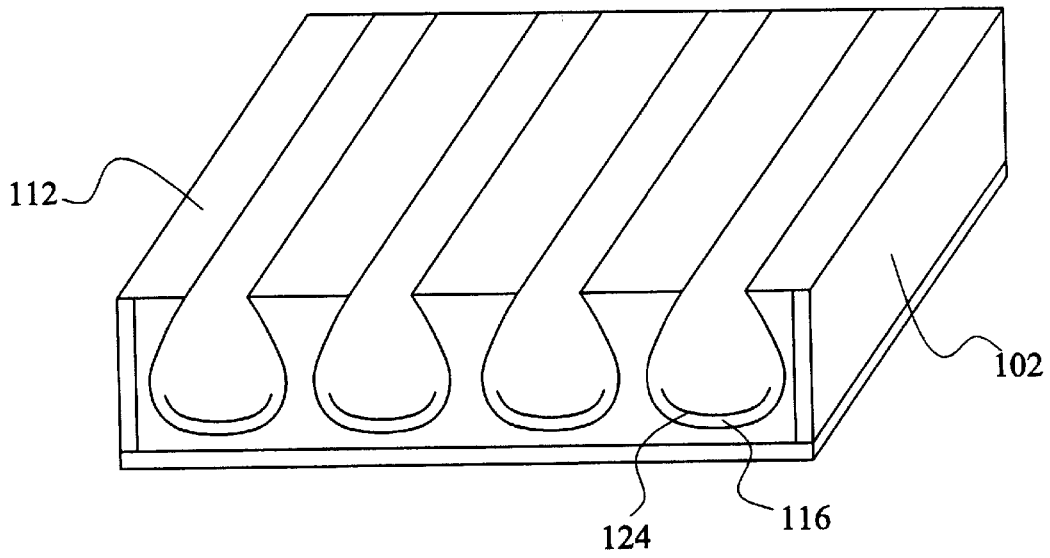
FIG. 5 is a cut-away view of a flat fluorescent lamp with a reflective coating in the interior portion of the enclosure.

Reflective material 124 may also be applied to all or part of the interior of the lamp enclosure to further enhance brightness. Reflective material 124 may be applied to the entire surface to redirect light that would have been rear-emitted toward the cover lid 114. Also, reflective materials may be applied to only a portion of the enclosure interior, for example to diffuse the bottom of channel 116 as shown in FIG. 5, yielding a masking effect which can be configured to direct light to strike the tapered sides at selected angles enhancing the selective angular tuning effect of the flat fluorescent lamp. Thus, use of channel tuning maximizes the usefulness of the light bar concentrating it into a smaller viewing range, without requiring the addition of more materials. Reflective material 124 in the lamp interior in combination with the selective angular tuning of emitted light by the diffuse channel 116 of the present invention will further increases the brightness enhancement provided by diffuse channel tuning.

From the foregoing, it can be seen that a flat fluorescent lamp with an enhanced brightness may be provided for by selective angular tuning of emitted light by altering the cross-sectional shape of the diffuse channels which focuses, and subsequently intensifies, the emitted cone of visible light. However, the applications of this invention are vast and many variations are available. In addition, it will be understood that the above descriptions are preferred exemplary embodiments only, and are not intended to be limiting in any way. Various modifications, substitutions, and other applications of the embodiments discussed herein may be made without departing from the spirit and the scope of the invention as set forth in the appended claims.

What is claimed is:

1. A fluorescent lamp having an increased brightness through selective angular tuning of emitted light comprising:

a substrate having end walls and side walls, such that said side walls and said end walls form an enclosed perimeter;

a cover lid that is at least partially transparent fixedly attached to said substrate and forming an enclosure, said enclosure having an interior portion and an exterior portion;

a diffuse channel milled in said substrate such that said diffuse channel is located in said interior portion of said enclosure, said diffuse channel shaped so that light exiting said cover lid is of enhanced brightness due to selective angular tuning;

a plasma contained within said interior of said enclosure formed by fixedly attaching said cover lid to said lamp body, said plasma producing light upon application of an energy source; and a fluorescent material contained within said interior of said enclosure.

2. A fluorescent lamp according to claim 1 wherein said diffuse channel is milled such that the upper walls of said diffuse channel taper inward toward the cavity of said diffuse channel.

3. A fluorescent lamp according to claim 2 wherein said diffuse channel has an asymmetrical cross section.

4. A fluorescent lamp according to claim 2, wherein said diffuse channel has an inward taper in the range of approximately 0° to 30°.

5. A fluorescent lamp according to claim 1 wherein said fluorescent material is a rare earth phosphor.

6. A fluorescent lamp according to claim 1 wherein said plasma producing light upon application of an energy source is selected from the group consisting of mercury and argon.

7. A fluorescent lamp according to claim 1 further comprising a reflective material at least partially covering said interior portion of said enclosure.

8. A fluorescent lamp according to claim 7 wherein said reflective material is positioned directly on the surface of said diffuse channel.

9. A fluorescent lamp according to claim 7 wherein said reflective material is selected from the group consisting of aluminum or ceramics.

10. A fluorescent lamp according to claim 1 further comprising a semi-transparent material at least partially covering the interior portion of said enclosure.

11. A method of producing a fluorescent lamp having an increased brightness through selective angular tuning of emitted light comprising the steps of:

providing a substrate having end walls and side walls, such that said side walls and said end walls form an enclosed perimeter;

milling said substrate so that a diffuse channel is formed therein, said diffuse channel shaped so that light exiting said lamp is of enhanced brightness due selective angular tuning;

attaching a cover lid being at least partially transparent fixedly to said substrate, forming an enclosure with an interior portion and an exterior portion, such that said diffuse channel is located in said interior portion of said enclosure;

covering said interior portion of said enclosure at least partially with a fluorescent material;

enclosing a plasma for producing light upon application of an energy source within said enclosure.

12. A method of producing a fluorescent lamp according to claim 11 wherein said diffuse channel is milled such that the upper walls of said diffuse channel taper inward toward the cavity of said diffuse channel.

13. A method of producing a fluorescent lamp according to claim 11 wherein said diffuse channel has an asymmetrical cross section.

14. A method of producing a fluorescent lamp according to claim 11 wherein said diffuse channel has an inward taper in the range of approximately 0° to 30°.

15. A method of producing a fluorescent lamp according to claim 11 wherein said fluorescent material is a rare earth phosphor.

16. A fluorescent lamp according to claim 11 wherein said plasma producing light upon application of an energy source is selected from the group consisting of mercury and argon.

17. A method of producing a fluorescent lamp according to claim 11 further comprising the step of covering said interior of said enclosure at least partially with a semi-transparent layer.

18. A method of producing a fluorescent lamp according to claim 11 further comprising the step of covering the interior of said enclosure at least partially with a reflective material.

19. A method of producing a fluorescent lamp according to claim 18 wherein said reflective material is positioned between directly on the surface of said diffuse channel.

20. A method of producing a fluorescent lamp according to claim 18 wherein said reflective material is selected from the group consisting of aluminum and ceramics.

21. A fluorescent lamp having an increased brightness through selective angular tuning of emitted light comprising:

a substrate having end walls and side walls, such that said side walls and said end walls form an enclosed perimeter;

a diffuse channel milled in said substrate, said diffuse channel having a first end and a second end and channel walls that have the upper portion tapered inward at approximately in the range of 0° to 30°;

a cover lid that is at least partially transparent fixedly attached to said substrate and forming an enclosure, said enclosure having an interior portion and an exterior portion, such that said diffuse channel is located in said interior portion of said enclosure;

a first electrode positioned approximately at said first end of said diffuse channel and a second electrode positioned approximately at said second end of said diffuse channel, said first and second electrodes extending into said enclosure and being electrically connected to respective terminals external to said enclosure;

a fluorescent material overlaying at least a portion of said interior of said enclosure;

a semi-transparent layer overlaying at least a portion of said interior portion of said enclosure; and a plasma within said enclosure for emitting energy in response to an electric potential between said first and second electrodes.

22. A fluorescent lamp according to claim 21 wherein said diffuse channel has an asymmetrical cross section.

23. A fluorescent lamp according to claim 21 further comprising a reflective material overlaying at least a portion of said enclosure, said reflective material located directly on said substrate.

24. A fluorescent lamp according to claim 22 wherein said reflective material is selected from the group consisting of aluminum and ceramics.

* * * * *